United States Patent [19]

LeMer

[11] Patent Number: 4,887,963

[45] Date of Patent: Dec. 19, 1989

[54] GAS BURNERS

[75] Inventor: Joseph LeMer, Saint Thegonnec, France

[73] Assignee: Chaffoteaux Et Maury, France

[21] Appl. No.: 326,804

[22] Filed: Mar. 21, 1989

[51] Int. Cl.[4] ..... F23D 14/62; F23D 14/12

[52] U.S. Cl. ..... 431/354; 431/328; 431/347

[58] Field of Search ..... 431/328, 329, 347, 354, 431/350; 126/39 F, 39 H, 39 J, 42 R, 92 AC

[56] References Cited

U.S. PATENT DOCUMENTS

| | | | |
|---|---|---|---|
| 1,518,577 | 12/1924 | Enright | 431/347 |
| 1,697,002 | 1/1929 | Evanko | 431/347 |
| 2,594,914 | 4/1952 | Grosskloss | 126/92 R |
| 3,445,175 | 5/1969 | Krieger | 431/328 |
| 3,551,085 | 12/1970 | Desty et al. | 431/354 X |
| 3,695,818 | 10/1972 | Mizutani | 431/328 |
| 3,847,534 | 11/1974 | Nomaguchi et al. | 431/329 |

*Primary Examiner*—Margaret A. Focarino
*Attorney, Agent, or Firm*—Larson and Taylor

[57] ABSTRACT

A gas burner is provided of the type distributing, through multiple nozzles (12), the flames (13) generated by the combustion of a pressurized fuel gas in air, comprising an air-fox (1) one wall (3) of which is perforated with a large number of closely spaced orifices (5), a gas feed-tank (7) connected to a pressurized fuel gas source and a plurality of hollow needles (11) each connecting the inside of the feed-tank (7) to the central zone of the inlet of an orifice (5) in the perforated wall (3) so as to define with this orifice one of the flame production sites (12). The air-box is connected to a pressurized air source, the orifices are cylindrical and a mechanical obstacle (16) is provided in the centre of the outlet of each orifice, for deflecting the gas jet leaving the needle and mixing it with the air stream which surrounds it.

16 Claims, 2 Drawing Sheets

GAS BURNERS

BACKGROUND OF THE INVENTION

The invention relates to gas burners of the type distributing, through multiple nozzles, the flames generated by the combustion of a pressurized fuel gas in air, this gas being for example one or other of the following : natural gas, butane, propane.

Such burners for example equip water heaters, bath heaters, domestic or industrial central heating boilers, cookers, . . .

The invention relates more particularly, among these burners, to those comprising an air-box, an outer wall of which is perforated with a large number of closely spaced orifices, a gas feed-tank connected to a source of pressurized fuel gas, this feed-tank being adapted so as to have, opposite the perforated wall of the air-box, a perforated partition sufficiently distant from said perforated wall for the air to flow freely between said wall and said partition and a plurality of hollow needles each connected sealingly to the edge of a hole of the partition and each opening into the central zone of the inlet of an orifice of the perforated wall so as to define therewith a nozzle for distributing the air-gas fuel mixture forming a flame production site.

In known embodiments of such burners, called "atmospheric" burners, the air-box communicates with the atmosphere and the air used for forming the flame generating fuel mixture is driven through the orifices by the stream of pressurized gas leaving the needle, said orifices having, for this purpose, a profile converging downstream.

It is then difficult to regulate the heating power of the burner over a wide range, because in particular of the need to avoid, for low powers, the extinction of certain flames by return thereof upstream and, for high powers, the extinction of certain flames by detachment thereof downstream.

In addition, the flame generating fuel mixture is not homogeneous, the relative proportion of gas to air being higher in the zone close to the outlet axis of each needle, in which zone the gas stream flows without being hindered by any obstacle, than in the peripheral regions of each distribution nozzle: the result is imperfect combustion of said mixture and the production of undesirable toxic gases, particularly carbon monoxide and nitrogen oxides, in the combustion products.

SUMMARY OF THE INVENTION

An object of the invention is especially to overcome these drawbacks.

For this, the burners of the kind in question in accordance with the invention are essentially characterized in that the air-box is connected to a pressurized air source, in that each orifice is formed by at least one cylindrical hole, and in that a mechanical obstacle is disposed across the central zone of the outlet of each orifice, in the axial extension of the corresponding needle, so as to deflect the gas jet leaving this needle towards the air stream surrounding this jet.

In preferred embodiments, recourse is further had to one and/or other of the following arrangements:

the mechanical obstacles are bridges dividing the corresponding orifices into two identical halves, the apertured zone of the perforated wall of the box is defined laterally by at least one succession of small through holes in this wall opening on the outside at the foot of a step projecting externally from the wall, complementary orifices are formed in the perforated wall of the air-box, spaced evenly apart between the above orifices and having a cross section less than that of these orifices, the orifices formed in the perforated wall of the air-box are circular and are defined by spot facings of the outer side of this wall, the orifices formed in the perforated wall of the air-box are joined together by grooves formed in the outer face of this wall, the bridges forming the mechanical obstacles are formed by thin wires housed in the above grooves, the perforated wall of the air-box and the perforated partition of the feed-tank are spaced apart by a distance of about a centimeter, the diameter of each orifice formed in the perforated wall is of the order of 4 mm, the inner diameter of each needle is of the order of 0.6 mm to 0.7 mm, its outer diameter is of the order of 1.2 to 1.4 mm, the distance between the axes of the adjacent needles is of the order of 6 to 8 mm, the diameter of each complementary orifice, if they are provided, is of the order of 2 to 3 mm and that of the small edge holes, if they are provided, is of the order of 2 to 3 mm, the perforated wall of the air-box is formed of two walls joined side by side, one on the inside and one on the outside, having perforations mutually offset so that the outer wall forms, opposite the central zones of the perforations of the inner wall, bridges forming mechanical obstacles, the perforations formed in the above walls have elongate shapes with parallel edges and are mutually aligned in the direction of their elongation, the two walls, joined side by side, are circular and their perforations are radially elongate, the bridges formed between the perforations in the inner wall are wider in the zones, of the walls joined side by side, the closest to the axis to these walls, the inner wall is thicker than the outer wall, the face, of the perforated wall of the air-box, inside this box, comprises, in the immediate vicinity of each orifice, at least one air intake adapted to impart a rotary movement to the air taken in through this orifice, the air-box has a general form of a cylindrical cake and the feed-tank, that of a hollow ring coaxial with the box and contained therein.

Apart from these main arrangements, the invention comprises certain other arrangements which are preferably used at the same time and which will be more explicitly discussed hereafter.

In what follows, two preferred embodiments of the invention will be described with reference to the accompanying drawings in a way which is of course in no wise limitative.

DETAILED DESCRIPTION OF THE PREFERRED EMBODIMENTS

Figure 1:
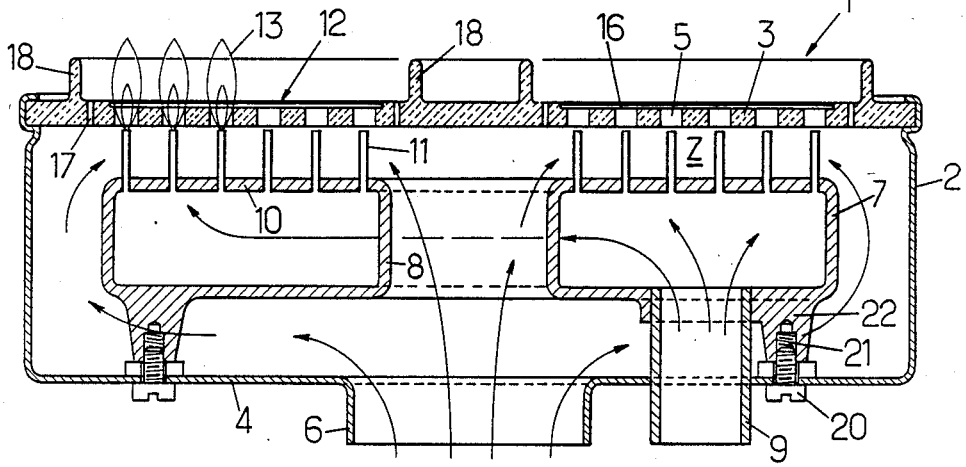
FIGS. 1 and 2, of these drawings, show respectively in axial section through I-I of FIG. 2 and a half plane view, a gas burner formed in accordance with the invention.
Figure 2:
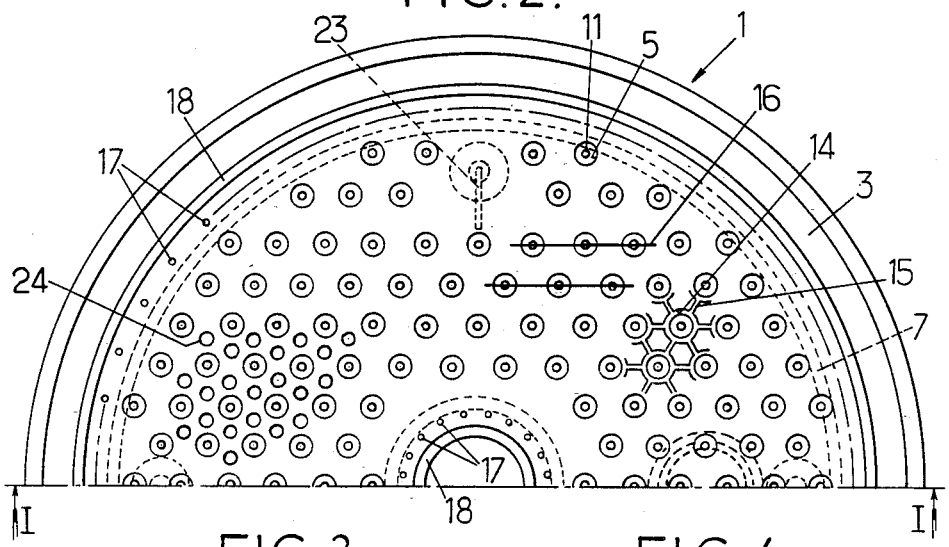
Figure 3:
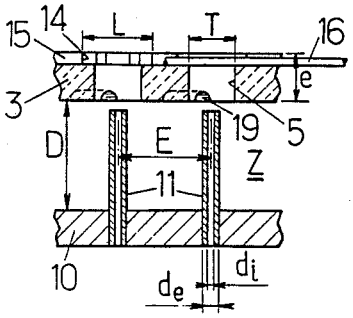
FIG. 3 is an enlarged detail of FIG. 1.
Figure 4:
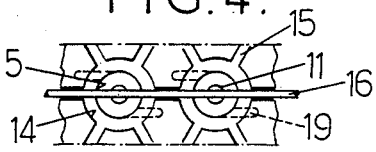
FIGS. 4 and 5 shows on a larger scale, respectively, a piece of the outer face of the perforated wall forming part of said burner and a piece of the inner face of this wall.
Figure 5:
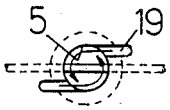

The burner shown in FIGS. 1 to 5 comprises an air-box 1 in the form of a thick cake, i.e. defined by a cylindrical side wall of revolution 2 and two flat transverse walls 3 and 4.

One of these flat walls 3 is perforated with a multitude of closely spaced orifices 5 whose inner face is cylindrical of revolution.

The other flat wall 4 has passing therethrough a duct 6 connecting the box to an external pressurized air source such as a fan (not shown).

Inside box 1 is housed a gas feed-tank 7, with clearances in all directions, which has, like box 1, the shape of a cylindrical cake, but smaller than said box and having centrally a chimney 8.

This feed-tank is disposed coaxially to box 1, it is connected by a pipe 9 to a pressurized fuel gas source and its flat wall 10 parallel to the perforated wall 3 bristles with a multitude of hollow needles 11 each connecting the inside of feed-tank 7 to the central zone of an orifice 5.

The distance D between the facing faces of wall 3 and partition 10 is fairly large so that the air flows freely in the space created between these elements and, for the same reason, the spacings E between the different needles are sufficiently large and the diameter $d_e$ sufficiently small.

The pressure of the air which occupies space Z is then the same at all points of this space.

Similarly, the inner volume of the annular feed-tank 7 is sufficiently large for the gas admitted therein through pipe 9 to be subjected to the same pressure at all points of this volume.

The result is that the pressurized gas flows distributed respectively at the outlets of the different needles 11 are all identical to each other and the pressurized air flows projected outside box 1, about the needle outlets, through orifices 5 are also identical with each other.

Consequently, the compositions of the air-gas mixtures to be burned which are distributed to the combustion sites themselves through the different nozzles 12 formed by orifices 5 and the outlets of needles 11 are identical with each other and very easy to adjust by regulating the intake pressure of the air into box 1 and/or that of the intake of gas into the feed-tank 7.

If, then, the two air and gas components of the fuel mixture are intimately mixed at the indicated sites, excellent and homogeneous combustion is automatically obtained at these sites at the time of the formation of multiple flames 13 due to the ignition of said mixture at said sites.

To provide such intimate mixing, a mechanical obstacle is provided in the central zone of each orifice 5, i.e. in the axial extension of each needle 11.

This obstacle deflects the gas jet leaving the needle by creating a certain turbulence which ensures intimate mixing thereof with the pressurized air stream which surrounds it just before the mixture obtained is distributed to the outlet of the corresponding nozzle.

In the embodiment shown in FIGS. 1 to 5, the obstacles in question are thin wires 16 formed more particularly of stainless steel, which wires are fixed to the outer face of the perforated wall 3 of the air-box, diametrically across the orifices 5.

The quality and homogeneity of the combustion may be further improved by adapting the perforated wall 3 of the air-box as follows:

the orifices 5, on the outer face side of said wall, are defined by spot facings 14, these spot facings 14 are joined together by hollow grooves 15 in said face forming a network of a small channels facilitating interignition as well as retention of flames 13, some of these grooves 15 receiving the above wires 16 which also serve as flame retainers, the annular perforated zone of wall 3 is defined, on the inside and on the outside, by a ring of small holes 17 passing through this wall from side to side and opening externally at the foot of a step 18 which projects externally from said wall, in the perforated zone of wall 3 a plurality of small circular orifices 24 are formed spaced evenly apart between orifices 5 and having a diameter less than that of these orifices 5, in the inner face of wall 3, in the immediate vicinity of each orifice 5, at least one air intake 19 (see FIGS. 3 to 5) is formed capable of imparting a rotary movement to the pressurized air taken in through this orifice, which improves mixing thereof with the fuel gas leaving the central needle 11, an advantage which is particularly precious when this gas is butane or propane.

in practice, the different dimensions of the components of the circular nozzles 12 are advantageously given the following values:

distance D, which corresponds substantially to the length of each needle 11 projecting from partition 10: 8 to 10 mm, preferably 9 mm, spacing E between the axes of adjacent needles: 5 to 9 mm, preferably 6 to 8 mm, inner diameter $d_i$ of each needle: 0.4 to 0.8 mm, preferably 0.6 mm to 0.7 mm, outer diameter $d_e$ of each needle: 1 to 1.5 mm, preferably 1.2 to 1.4 mm, thickness e of the perforated wall 3: 2 to 5 mm, diameter T of each orifice 5: 3 to 5 mm, preferably 4 mm, diameter L of each spot facing 14: 5 to 7 mm, preferably 6 mm, and depth thereof: about 1 mm.

The diameter of holes 17 and that of orifices 24, if they are provided, are advantageously of the order of 2 to 3 mm.

The number of needles is generally several tens, even several hundreds.

The transverse plane into which each needle opens is generally situated axially a little short of the level of the inner surface of the perforated wall 3 of box 1, i.e. inside the box, but it may be situated a little beyond this level towards the outside, without exceeding that of the outer surface of wall 3.

In the drawings there can also be seen:

screws 20 (FIG. 1) for fixing the feed-tank 7 inside box 1 and cooperating with threaded complementary bores 21 formed in extra thick portions 22 of this feed-tank, and an igniter 23 (FIG. 2) for example of the piezoelectric spark type.

The air-box 1 is generally formed from stamped metal sheet, for example made from stainless steel or aluminium, including its perforated wall 3, which could however be formed of a moulded or sintered ceramic, whereas feed-tank 7 is formed by a metal part, for example made from moulded aluminium alloy.

Figure 6:
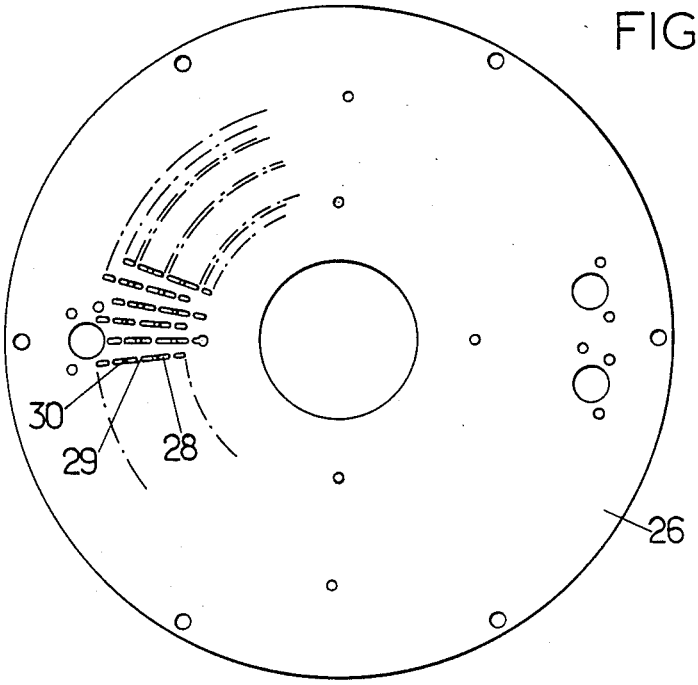
FIG. 6 shows in a top view a gas burner variant in accordance with the invention.
Figure 7:
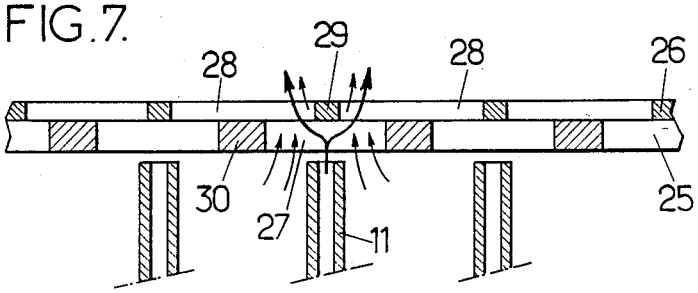
FIGS. 7 and 8 show on a larger scale a portion of this burner in axial section through VII—VII of FIG. 8 and in a top view.
Figure 8:
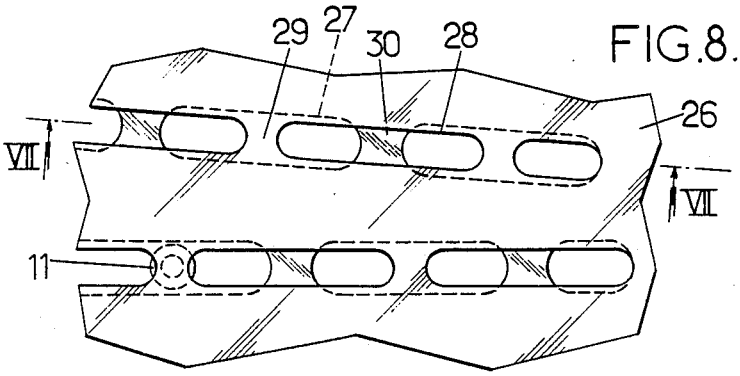

The burner shown in FIGS. 6 to 8 is of the same type as the preceding one and only differs by the outer perforated wall of the air-box.

This wall again has the general form of a circular plate but this plate is here formed of two flat disks 25, 26, joined side by side, one of these disks 25 disposed on the inner side of the box being preferably thicker than the other outer disk 26, the thickness of each disk being particularly of the order of 1 to 2 mm.

The orifices formed in said wall are not circular holes here but radial slits each formed by a first slit 27 formed in the inner disk 25 and by two radially aligned radial slits 28 in the outer disk 26, the inner lateral faces of said slits being all cylindrical.

The two radial slits 28 are separated by a bridge 29 situated opposite the centre of the corresponding slit 27, i.e. in the axial extension of the corresponding needle 11.

Bridges 29 here play the role of deflecting obstacle and turbulence creator, even flame retainer, which was played by wires 16 in the preceding embodiment.

Slits 27 are separated by bridges 30 which the pressurized air streams strike when they tend to escape from the air-box.

The different perforations of the two disks are designed so that the simple axial juxtaposition of these two disks, in well defined relative angular positions, results in the presence of a bridge 29 facing each slit 27.

In the embodiment illustrated in FIGS. 6 to 8, these perforations are all narrow radial slits and are radially aligned, the width of slits 27 formed in disk 25 being slightly greater than that of slits 28 - which is typically of the order of 2 mm - and bridges 30 mutually separating slits 27 are all the wider the closer they are to the common axis of the two disks.

Slits 27 and 28 could also have other shapes than rectilinear and radial by extending, for example, along rectilinear segments slanted with respect to the corresponding radii, or along concentric arcs of a circle, or else along arcs of a spiral or even crosses.

In each case, these slits are defined laterally by cylindrical walls, which means that they can be formed by simple stamping of metal sheets.

In each case, an obstacle is provided opposite the centre of each slit and this obstacle is bordered by empty spaces which are sufficiently wide to allow the flame generating fuel mixture to be distributed therethrough without hindrance to the outside of box 1.

The obstacle in question is generally, as before, at the level of its outlet, a bridge crossing the associated distribution orifice, which it divides into two identical halves.

Here again, additional holes intended solely for the passage of pressurized air could be formed in the disks.

The flow of the air-gas mixture may be regulated once and for all by giving predetermined values to the flowrates of its two components, the ratio between these two flowrates corresponding to the stoichiometric formula of perfect combustion increased by the minimum air excess required by standards, considering the possible air supply through the holes (17, 24) not associated with needles (11).

In an advantageous variant, the flowrates or pressures of the two components may be regulated at will while of course taking care that the composition of the mixture remains close to its optimum value.

Thus, the heating power of the burner may be "modulated".

Such modulation is here possible in an extremely wide range since it may go from 1 to 20 and even more whereas with the prior known constructions with "atmospheric" burners it was difficult to exceed a ratio of 4 between the two endmost values of the heating power which the burner was capable of generating.

Thus, the above described burner may deliver at will a heating power varying from 2 to 30 kw and even beyond, i.e. starting from an extremely low minimum value for which the flame is reduced to a minute blue bead visible only in darkness up to the maximum value corresponding to the pressure of the network or other gas source and to that of the blown air, taking into account the dimensions of the distribution orifices.

Following which, and whatever the embodiment adopted, burners are finally obtained whose construction and operation follow sufficiently from the foregoing.

These burners have numerous advantages with respect to those known heretofore, particularly:

in that they permit excellent combustion over the whole of the "area" of the burner, defined by the perforated zone of its air-box, which reduces, even cancels out, the proportion of undesirable toxic gases (such as carbon monoxide and nitrogen oxides) in the combustion products, an in that they lend themselves to very simple power regulation over an extremely wide range which may exceed the ratio of 1 to 20 between its endmost values.

As is evident, and as it follows moreover from what has gone before, the invention is in no wise limited to those of its modes of application and embodiments which have been more especially considered; it embraces, on the contrary, all variants thereof, particularly:

those in which the flames 13 have an orientation other than vertically ascending, for example vertically descending, or horizontal, and those in which the perforated wall from which the carpet of flames extends has a form other than that illustrated of a flat washer, for example that of a flat disk, or else that of a flat and elongate rectangle forming a sort of "ignited ramp", or even that of at least the lateral surface of a cylinder, of revolution or not, or else that of a hemisphere or of a sphere to the exclusion of a portion of this sphere reserved for the radial intakes required for the gas components.

What is claimed:

1. Gas burner comprising an air-box (1), an outer wall (3; 25,26) of which is perforated with a large number of closely spaced orifices, a gas feed-tank (7) connected to a source of pressured fuel gas, this feed-tank being adapted so as to have, opposite the perforated wall of the air-box, a perforated partition (10) sufficiently distant from said perforated wall for the air to flow freely between said wall and said partition and a plurality of hollow needles (11) each connected sealingly to the edge of a hole of the partition and each opening into the central zone of the inlet of an orifice (5; 27, 28) of the perforated wall so as to define therewith a nozzle (12) for distributing the air-gas fuel mixture forming a flame (13) production site, characterized in that the air-box (1) is connected to a pressurized air source, in that each orifice (5; 27, 28) is formed by at least one cylindrical hole, and in that a mechanical obstacle (16; 29) is disposed across the central zone of the outlet of each orifice, in the axial extension of the corresponding needle (11), so as to deflect the gas jet leaving this needle towards the air stream surrounding this jet.

2. Burner according to claim 1, characterized in that the mechanical obstacles (16; 29) are bridges dividing the corresponding orifices (5; 27;, 28) into two identical halves.

3. Burner according to claim 1, characterized in that the apertured zone of the perforated wall (3;25, 26) of the box (1) is defined laterally by at least one succession of small through holes (17) in this wall and opening on the outside at the foot of a step (18) projecting externally from the wall.

4. Burner according to claim 1, characterized in that complementary orifices (24) are formed in the perforated wall of the air-box, spaced evenly apart between the above orifices and having a cross section less than that of these orifices.

5. Burner according to claim 1, characterized in that the orifices (5) formed in the perforated wall (3) of the air-box are circular and are defined by spot facings (14) on the outer side of this wall.

6. Burner according to claim 5, characterized in that the orifices (5) are joined together by grooves (15) formed in the outer face of the wall (3).

7. Burner according to claim 6, characterized in that the bridges forming the mechanical obstacles are formed by thin wires (16) housed in the grooves (15).

8. Burner according to claim 1, characterized in that the perforated wall of the air-box (1) and the perforated partition of the feed-tank (7) are spaced apart by a distance (D) of the order of a centimeter, in that the diameter (T) of each orifice (5) formed in the perforated wall is of the order of 4 mm, in that the inner diameter ($d_i$) of each needle (11) is of the order of 0.6 mm to 0.7 mm, in that its outer diameter ($d_e$) is of the order of 1.2 to 1.4 mm, in that the distance (E) between the axes of the adjacent needles is of the order of 6 to 8 mm, in that the diameter of each complementary orifice (24), if they are provided, is of the order of 2 to 3 mm and in that that of the small edge holes (17), if they are provided, is of the order of 2 to 3 mm.

9. Burner according to claim 1, characterized in that the perforated wall of the air-box is formed of two walls joined side by side (25, 26), one on the inside and one on the outside, having perforations (27, 28) mutually offset so that the outer wall forms, opposite the central zones of the perforations of the inner wall, bridges (29) forming mechanical obstacles.

10. Burner according to claim 9, characterized in that the perforations (27, 28) have elongate shapes with parallel edges and are mutually aligned in the direction of their elongation.

11. Burner according to claim 10, characterized in that the two walls (25, 26) , joined side by side, are circular and in that their perforations (27, 28) are radially elongate.

12. Burner according to claim 11, characterized in that the bridges (30) formed between the perforations (27) in the inner wall (25) are wider in the zones, of the walls joined side by side, the closest to the axis of these walls.

13. Burner according to claim 9, characterized in that the inner wall (25) is thicker than the outer wall (26).

14. Burner according to claim 9, characterized in that the walls (25, 26), joined side by side, have thicknesses of the order of 1 to 2 mm and in that the perforations (27, 28) formed in these walls are stamped slits whose width is of the order of 2 mm.

15. Burner according to claim 1, characterized in that the face, of the perforated wall of the air-box, inside this box, comprises, in the immediate vicinity of each orifice, at least one air intake (19) adapted to impart a rotary movement to the air taken in through this orifice.

16. Burner according to claim 1, characterized in that the air-box (1) has a general form of a cylindrical cake and the feed-tank (7), that of a hollow ring coaxial with the box and contained therein.

* * * * *

UNITED STATES PATENT AND TRADEMARK OFFICE

CERTIFICATE OF CORRECTION

PATENT NO. : 4,887,963

DATED : December 19, 1989

INVENTOR(S) : LE MER, Joseph

It is certified that error appears in the above-identified patent and that said Letters Patent is hereby corrected as shown below:

In the heading of the cover page, left hand side, just beneath the filing date, please add the following:

[30] Foreign Application Priority Data

Mar. 21, 1988 [FR] France.....88-03618

Signed and Sealed this

Fourth Day of December, 1990

*Attest:*

*Attesting Officer*

HARRY F. MANBECK, JR.

*Commissioner of Patents and Trademarks*